US012680180B2

(12) United States Patent
Seger et al.

(10) Patent No.: US 12,680,180 B2
(45) Date of Patent: Jul. 14, 2026

(54) $CO_2$ AND CO ELECTROLYSIS TO PRODUCE HIGH PURITY ISOTOPICALLY LABELLED ORGANIC COMPOUNDS

(71) Applicant: Danmarks Tekniske Universitet, Kongens Lyngby (DK)

(72) Inventors: Brian Seger, Kongens Lyngby (DK); Gastón Larrazábal Labrador, Kongens Lyngby (DK); Bjørt Óladóttir Joensen, Kongens Lyngby (DK)

(73) Assignee: Danmarks Tekniske Universitet, Kongens Lyngby (DK)

( * ) Notice: Subject to any disclaimer, the term of this patent is extended or adjusted under 35 U.S.C. 154(b) by 4 days.

(21) Appl. No.: 18/854,407

(22) PCT Filed: Apr. 4, 2023

(86) PCT No.: PCT/EP2023/058789

§ 371 (c)(1),
(2) Date: Oct. 4, 2024

(87) PCT Pub. No.: WO2023/194360

PCT Pub. Date: Oct. 12, 2023

(65) Prior Publication Data

US 2025/0223711 A1 Jul. 10, 2025

(30) Foreign Application Priority Data

Apr. 7, 2022 (EP) ..... 22167122

(51) Int. Cl.

| | |
|---|---|
| ***C25B 9/23*** | (2021.01) |
| ***C25B 3/03*** | (2021.01) |
| ***C25B 3/25*** | (2021.01) |
| ***C25B 3/26*** | (2021.01) |
| ***C25B 11/032*** | (2021.01) |
| ***C25B 11/075*** | (2021.01) |
| ***C25B 15/00*** | (2006.01) |

(52) U.S. Cl.

CPC ..... *C25B 9/23* (2021.01); *C25B 3/03* (2021.01); *C25B 3/25* (2021.01); *C25B 3/26* (2021.01); *C25B 11/032* (2021.01); *C25B 11/075* (2021.01); *C25B 15/00* (2013.01)

(58) Field of Classification Search

None

See application file for complete search history.

(56) References Cited

U.S. PATENT DOCUMENTS

2020/0056294 A1 2/2020 Kanan et al.
2021/0062349 A1* 3/2021 Agapie ..... B01J 23/72
(Continued)

OTHER PUBLICATIONS

Ropp et al. "Studies Involving Isotopically Labelled Formic Acid and its Derivatives. III. Positive and Negative Ions Produced by Electron Impact in Formic Acid and Deuteroformic Acids," Journal of the American Chemical Society, 80, 3509-3512 (Jul. 20, 1958).
(Continued)

*Primary Examiner* — Wojciech Haske
(74) *Attorney, Agent, or Firm* — WOMBLE BOND DICKINSON (US) LLP

(57) ABSTRACT

The present invention relates to a process for producing a isotopically labelled organic compound or a mixture of such compounds in a gas-fed zero-gap electrolyser device.

23 Claims, 8 Drawing Sheets

(56) References Cited

U.S. PATENT DOCUMENTS

| | | | | |
|---|---|---|---|---|
| 2021/0140056 | A1* | 5/2021 | Jiao | C25B 9/19 |
| 2022/0267916 | A1* | 8/2022 | Zhao | C25B 13/08 |

OTHER PUBLICATIONS

Choi et al. "Origin of Hydrogen Incorporated into Ethylene during Electrochemical CO2 Reduction in Membrane Electrode Assembly," ACS Energy Letters, 7, 939-945 (2022).
International Search Report dated Sep. 5, 2023 for PCT/EP2023/058798, 4 pages.

* cited by examiner

| Electrode | Potential vs. SHE V | Current density mA $cm^{-2}$ | Faradaic efficiency, % | | | | | | | |
|---|---|---|---|---|---|---|---|---|---|---|
| | | | $CH_4$ | $C_2H_4$ | EtOH[a] | PrOH[b] | CO | $HCOO^-$ | $H_2$ | Total |
| Pb | −1.63 | 5.0 | 0.0 | 0.0 | 0.0 | 0.0 | 0.0 | 97.4 | 5.0 | 102.4 |
| Hg | −1.51 | 0.5 | 0.0 | 0.0 | 0.0 | 0.0 | 0.0 | 99.5 | 0.0 | 99.5 |
| Tl | −1.60 | 5.0 | 0.0 | 0.0 | 0.0 | 0.0 | 0.0 | 95.1 | 6.2 | 101.3 |
| In | −1.55 | 5.0 | 0.0 | 0.0 | 0.0 | 0.0 | 2.1 | 94.9 | 3.3 | 100.3 |
| Sn | −1.48 | 5.0 | 0.0 | 0.0 | 0.0 | 0.0 | 7.1 | 88.4 | 4.6 | 100.1 |
| Cd | −1.63 | 5.0 | 1.3 | 0.0 | 0.0 | 0.0 | 13.9 | 78.4 | 9.4 | 103.0 |
| Bi[c] | −1.56 | 1.2 | - | - | - | - | - | 77 | - | - |
| Au | −1.14 | 5.0 | 0.0 | 0.0 | 0.0 | 0.0 | 87.1 | 0.7 | 10.2 | 98.0 |
| Ag | −1.37 | 5.0 | 0.0 | 0.0 | 0.0 | 0.0 | 81.5 | 0.8 | 12.4 | 94.6 |
| Zn | −1.54 | 5.0 | 0.0 | 0.0 | 0.0 | 0.0 | 79.4 | 6.1 | 9.9 | 95.4 |
| Pd | −1.20 | 5.0 | 2.9 | 0.0 | 0.0 | 0.0 | 28.3 | 2.8 | 26.2 | 60.2 |
| Ga | −1.24 | 5.0 | 0.0 | 0.0 | 0.0 | 0.0 | 23.2 | 0.0 | 79.0 | 102.0 |
| Cu | −1.44 | 5.0 | 33.3 | 25.5 | 5.7 | 3.0 | 1.3 | 9.4 | 20.5 | 103.5[d] |
| Ni | −1.48 | 5.0 | 1.8 | 0.1 | 0.0 | 0.0 | 0.0 | 1.4 | 88.9 | 92.4[e] |
| Fe | −0.91 | 5.0 | 0.0 | 0.0 | 0.0 | 0.0 | 0.0 | 0.0 | 94.8 | 94.8 |
| Pt | −1.07 | 5.0 | 0.0 | 0.0 | 0.0 | 0.0 | 0.0 | 0.1 | 95.7 | 95.8 |
| Ti | −1.60 | 5.0 | 0.0 | 0.0 | 0.0 | 0.0 | tr. | 0.0 | 99.7 | 99.7 |

Fig. 2

| Selectivity @ 200 mA/cm2 / Temperature (°C) | Hydrogen | CO | Methane | Ethylene | Formate | Acetate | Ethanol | Acetaldehyde | n-propanol | Others/ unaccounted |
|---|---|---|---|---|---|---|---|---|---|---|
| 30 | 39 | 13.9 | 1.9 | 17.6 | 1 | 5.1 | 11.8 | 0.5 | 1.8 | 7.4 |
| 40 | 21.4 | 12.5 | 0.1 | 28 | 4 | 7 | 9.8 | 2.1 | 2.4 | 12.7 |
| 50 | 11.5 | 28.9 | 0.2 | 20.6 | 1.6 | 3 | 12.6 | 0.1 | 4.8 | 16.8 |
| 60 | 18.3 | 51.5 | 0 | 10.8 | 0.7 | 0.4 | 5.1 | 0.2 | 0.4 | 12.6 |
| 70 | 18.3 | 39.7 | 0.2 | 17.8 | 0.9 | 1.7 | 3.3 | 0.1 | 0.7 | 17.2 |
| 80 | 18.2 | 34.8 | 0.7 | 16.5 | 2.5 | 3.7 | 11 | 1.8 | 2.9 | 7.9 |

Fig. 4

$CO_2$ AND CO ELECTROLYSIS TO PRODUCE HIGH PURITY ISOTOPICALLY LABELLED ORGANIC COMPOUNDS

CROSS-REFERENCE TO RELATED APPLICATIONS

This application is a national stage filing under 35 U.S.C. § 371 of PCT/EP2023/058798, filed Apr. 4, 2023, which was published by the International Bureau in English on Oct. 12, 2023, and which claims the benefit of European Patent Application No. 22167122.5, filed Apr. 7, 2022, each of which application is incorporated by reference herein in its entirety.

TECHNICAL FIELD

The present invention relates to a process for producing isotopically labelled organic compounds or a mixture thereof in a gas-fed zero-gap electrolyser device and more particularly to a process involving the electrolysis of a small C, O-containing species, including $CO_2$ and/or CO, in the presence of $D_2O$ and a catalyst, wherein at least one of the C and/or O atoms in said species is selected from an isotope of the at least one of the C and/or O atoms.

BACKGROUND

The electrochemical reduction of $CO_2$, also known as $CO_2$ electrolysis, is an emerging field. The electrochemical reduction of $CO_2$ produces numerous products, such as carbon monoxide (CO), formate salts (KCOOH, NaCOOH, CsCOOH), methane ($CH_4$), ethylene ($C_2H_4$). While researchers have successfully produced these products in the lab, this field is not to a stage of full commercialization given that no $CO_2$ electrolyzers can be readily purchased commercially currently. Thus there has yet to be a clear direction or specific product that has been proven to be commercially viable over the current technology. $CO_2$ electrolysis to carbon monoxide has been the most advanced technically and has the advantage of producing in-situ a toxic chemical resulting in minimal storage and decreased safety issues, but it is yet to be clear if there is a viable market for this compared to its fossil fuel competitors.

Known isotopically labelled compounds are routinely used today as e.g. solvents in NMR spectroscopy, while other compounds may be used as tracers of biochemical reactions in humans, animals or plants or in various imaging systems, such as PET scans. Another market relates to using isotopically labelled species in a research setting to understand reaction mechanisms and potentially solvents can be involved. Mass spectrometry is normally used in connection with isotope labelled work to analyse results. The production of isotopically labelled compounds is an expensive, multi-step process that traditionally yields limited quantities of isotopologues at a great cost.

The most common route to obtain deuterated ethanol is via converting ethanol, in the presence of $D_2O$ and a Ru-catalyst in a 24-hour batch process.

Deuterated ethylene is commonly produced via the following route:

$$CaC_2 + D_2 \rightarrow C_2D_2$$

$$C_2D_2 + D_2 \rightarrow C_2D_4$$

This route is expensive, and $CaC_2$ is obtained via cement processing; which creates high $CO_2$ emissions.

Deuterated chloroform is commonly produced via the following route: $(CH_3)_2CO+KOD+2\ Cl_2 \rightarrow CH_3COOK+CDCl_4$ Other, isotopically labelled products are available on the market, for example $^{13}C$-labelled propene ($^{13}CH_3{}^{13}CH{=}{}^{13}CH_2$) or ethylene ($H_2{}^{13}C{=}{}^{13}CH_2$) or deuterated ethanol ($CD_3CD_2OH$).

The electrochemical conversion of $CO_2$ to ethanol has been described in e.g. WO2017192515A1. Methods for producing radioactively labelled carboxylates are also known from US2012186988A1.

US 2020/056294 discloses an electrochemical cell for producing isotopically labelled organic compounds in a zero-gap electrolyser device. Chol Woong et al.: 'Origin of Hydrogen Incorporated into Ethylene during Electrochemical CO2 reduction in Membrane Electrode Assembly', ACS ENERGY LETTERS, vol. 7, no. 3, 11 February 2022 (Feb. 11, 2022), pages 939-945 discloses H-isotope labelling of ethylene. Thus, there is a need to produce isotopically labelled compounds at a low cost, in relatively large quantities, from readily-available starting materials, and at high conversion rates. The present process also has the potential to provide isotopically labelled organic compounds which are previously unknown.

SUMMARY

It is an object of the invention to provide a method for producing isotopically labelled compounds and compounds with isotope labelling comprising more than one isotope (isotope mixing) for use as tracers, in diagnostics or chemical or biochemical analysis or in the fine chemicals industry.

Thus, one aspect of the invention relates to a process for producing an isotopically labelled organic compound or a mixture of such compounds in a gas-fed zero-gap electrolyser device comprising a separator, the process involving electrolysis of a gas comprising:

a carbon-containing species, preferably $CO_2$ or CO, in said gas-fed zero-gap electrolyser device, in the presence of a catalyst, $D_2O$, and a cation;

wherein at least one of the C atoms in the carbon-containing species is selected from $^{11}C$, $^{12}C$, $^{13}C$ and/or $^{14}C$; and/or wherein at least one of the O atoms in the carbon-containing species and/or the $D_2O$ is selected from $^{16}O$, $^{17}O$ and/or $^{18}O$; and wherein the process comprises pre-soaking the membrane in $D_2O$ prior to the electrolysis of the gas.

Further aspects are evident in the enclosed claims, figures and description text.

FIGURES

FIG. 1 shows a zero-gap cell in accordance with the invention.

FIG. 2 shows the Faradic Efficiencies of products in $CO_2$ reduction at various metal electrodes. See: Hori, Y. Electrochemical CO2 Reduction on Metal Electrodes. In Modern Aspects of Electrochemistry, Vayenas, C. G.; White, R. E.; Gamboa-Aldeco, M. E., Eds.; Springer, 2008; Vol. 42, pp 89-189.

FIGS. 3*a* and 3*b* shows the hypothesised conversion mechanism of $CO_2$ and CO when subjected to electrolysis in accordance with the invention.

FIG. 4 shows a typical product distribution of a $CO_2$ electrolysis reaction.

DETAILED DISCLOSURE

Figure 1:
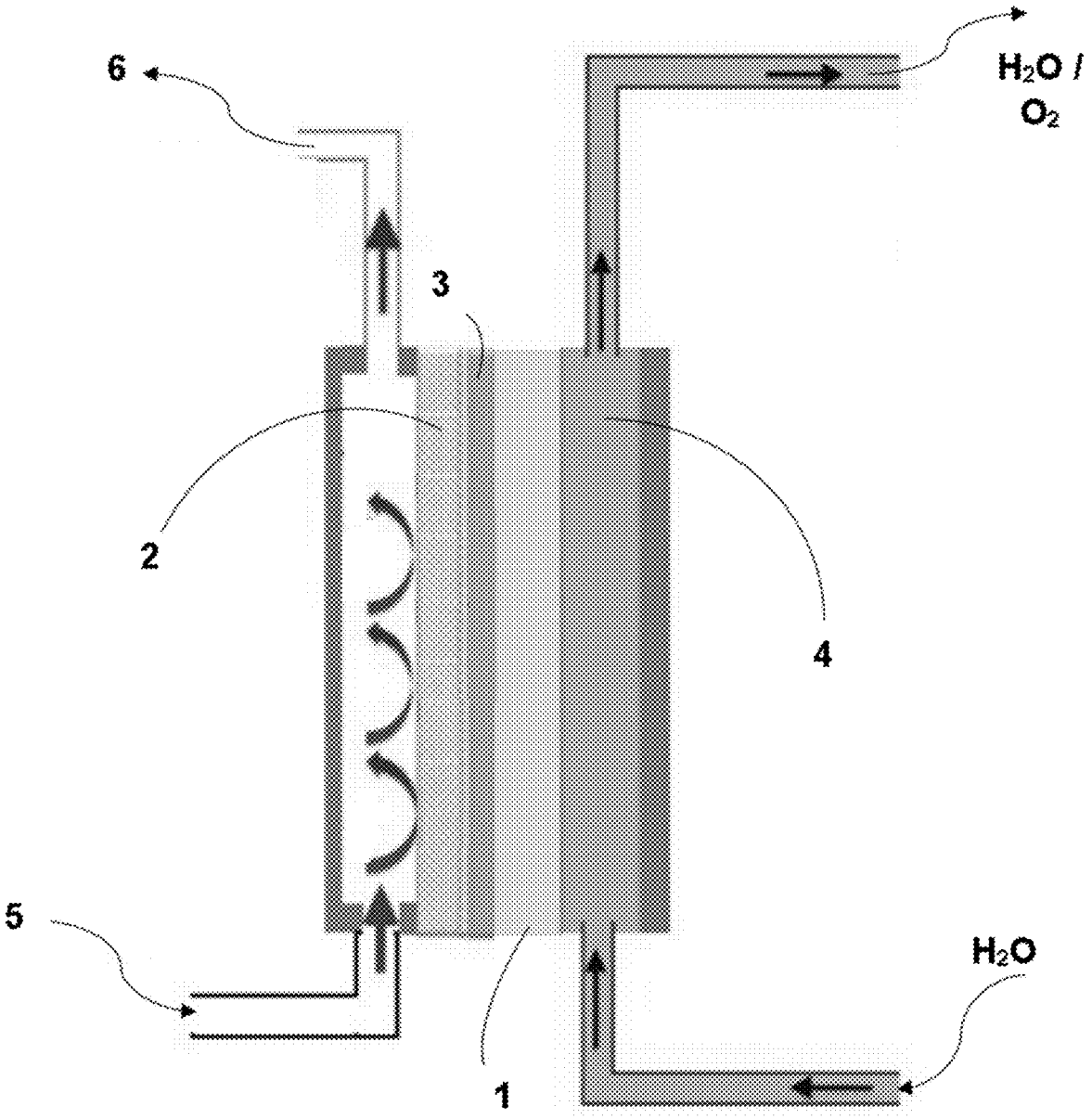

Accordingly, the inventors of the present invention found an efficient process for producing an isotopically labelled organic compound or mixture thereof, which has the potential to provide isotopically labelled organic compounds which were previously unknown.

Definitions

The term 'isotopically labelled organic compound' in the context of the application refers to an organic compound, where one or more of the atoms of the compound are substituted for an atom of the same chemical element, but of a different isotope. The isotope may be a radioactive isotope (i.e. a radioisotope) and/or may be stable isotopes (i.e. those that have never been observed to decay radioactively).

The labels may be selected from the isotopes of a chemical element, which isotope may be not the most commonly naturally abundant isotope, i.e. the labels may be selected as one or more of the less common isotopes of a chemical element. For example, the label may be selected from $^{11}C$ and/or $^{12}C$ and/or $^{13}C$ and/or $^{14}C$; and/or $^{16}O$ and/or $^{17}O$ and/or $^{18}O$. The isotope may also be D (deuterium).

The term 'zero gap electrolyzer device' or 'zero gap cell' or 'membrane electrode assembly (MEA) cell' refers to an electrolysis cell, in which two electrodes, i.e. the anode and cathode are pressed against a separator, such as a membrane, so as to create a 'zero gap cell', wherein there is substantially no gap between the cathodes, anodes and the electrolyte, i.e. that the electrodes are spacially separated from each other only by the separator (e.g. cation exchange membranes, anion exchange membranes, biopolar membranes or diaphragms). It is understood that the term 'zero gap electrolyzer device' and 'zero gap cell' are interchangeably used throughout the application text.

The term 'gas fed' refers to the state of at least the carbon-containing species. In the context of present application, it is understood that at least the carbon-containing species, preferably $CO_2$ or CO are introduced into the zero-gap electrolyzer device as a gas.

The term 'electrolyte' refers to an electrically conducting liquid or solid, containing ions and allowing a current to flow when a potential is applied.

A process is thus provided for producing an isotopically labelled organic compound or a mixture of such compounds in a gas-fed zero-gap electrolyser device comprising a membrane, the process involving electrolysis of a gas comprising:

a carbon-containing species, preferably $CO_2$ or CO, in said gas-fed zero-gap electrolyser device, in the presence of a catalyst, $D_2O$, and a cation;

wherein at least one of the C atoms in the carbon-containing species is selected from $^{11}C$, $^{12}C$, $^{13}C$ and/or $^{14}C$; and/or wherein at least one of the O atoms in the carbon-containing species and/or the $D_2O$ is selected from $^{16}O$, $^{17}O$ and/or $^{18}O$; and wherein the process comprises pre-soaking the membrane in $D_2O$ prior to the electrolysis of the gas.

Suitably, at least one of the C atoms in the carbon-containing species is selected from $^{11}C$, $^{12}C$, $^{13}C$ and/or $^{14}C$. Alternatively, or additionally at least one of the O atoms in the carbon-containing species and/or the $D_2O$ is selected from $^{16}O$, $^{17}O$ and/or $^{18}O$.

Without being bound by theory, the overall processes taking place and the corresponding standard electrode potentials, estimated with respect to the Reversible Hydrogen Electrode (RHE) in aqueous media at 25° C. are as follows:

Reduction at the Cathodic Side in Theory:

$$CO_2 + H_2O + 2e^- \rightarrow CO + 2OH^- (-0.11\ \text{V vs. } RHE)$$

The operating potential in practice is typically higher due to inefficiencies and imperfect catalysts and it is well-known in the art to add 0.5-1.0 V for practical conditions.

The competing Hydrogen Evolution Reaction (HER):

$$H_2O + 2e^- \rightarrow H_2 + 2OH^- (0.00\ \text{V vs. } RHE)$$

Alternatively, a competing HER reaction, i.e. the processes of $CO_2$/CO reduction, ethylene, ethanol, $HCOO^-$ and $CH_4$ occur:

$$CO_2 + H_2O + 2e^- \rightarrow HCOO^- + OH^- (-0.53\ \text{V vs. } NHE @ \text{pH} = 7)$$

$$CO_2 + 6H_2O + 8e^- \rightarrow CH_4 + 8OH^- (-0.17\ \text{V vs. } RHE).$$

At the anode side, the oxidisation reaction (also called Oxygen Evolution reaction or OER) occurs:

$$2OH^- \rightarrow 1/2\ O_2 + H_2O + 2e^- (-1.23\ \text{V vs. } RHE)$$

In a zero-gap cell, such as the one shown in FIG. 1, the chemical reactions take place at the electrodes 1,2.

A zero-gap cell (i.e. the electrolyser device) has the advantage that it allows efficient mass transfer of $CO_2$ to the catalyst, thus allowing for high current densities (>100 mA/cm$^2$, preferably 100-5000 mA/cm$^2$). The compact design of zero-gap cells also reduces ohmic losses related to ion transfer from the cathode 2 to the anode 1, thus reducing resistance to a minimum while increasing conductivity to the maximum. Essentially any ion in solution can contribute to this ion transfer, e.g. carbonates, hydroxyl groups, protons, alkali earth metals, alkali metals, formate, acetate.

A typical zero-gap cell comprises an anode side and a cathode side in a housing. Typically, the housing of a zero-gap cell comprises an endplate on both sides. The endplate is not necessary, however it provides mechanical support to the zero-gap cell. The endplates may be made of any suitable non-conductive material, such as anodized aluminium. A current collector is fixed to the end plates for collecting current from the anode and the cathode. A current collector may be a copper current collector, however other suitable collectors may be used.

A flow field is fixed onto the current collectors to bring in the reactant and to flow them evenly across the device in order to fill the outlet with the products obtained by the electrolysis reaction. The flow field may have a variety of suitable designs and may use a variety of suitable materials. For example, a titanium flow field may be used at the anode and a graphite flow field at the cathode. Alternatively, titanium flow fields may be used on both the anode and cathode side. The flow fields may be fastened with fastening means, such as cell bolts or any other conventional methods. The fastening means provides sufficient compression and prevents leakages into the system. A gasket may be used to avoid liquid leaks. The gasket may be a compressible but inert material, such as PTFE (polytetrafluoroethylene), however other suitable materials may be used.

A gas diffusion electrode is then fixed onto the gasket on the anode side. On the anode side, where the oxygen evolution reaction occurs, the electrode may be any type of electrode, which is stable at oxidising potentials, such as mixed metal oxides, for example $IrO_2$ or $RuO_2$ or $IrO_2$ or $RuO_2$ mixed with titanium. Other suitable electrodes may be used, such as NI oxides or Co oxides or noble metals, such as Pt or Au. A catalyst support, such as a gas diffusion layer may be deposited on the surface of the electrode. The gas diffusion layer may be a stable fiber or porous network known in the art.

A liquid electrolyte or anolyte 4 is pumped into the zero-gap electrolyser device on the anode side, which may be recycled throughout the device. Part of the $H_2O$ on the anode side is converted to $O_2$ and the unreacted $H_2O$ is pumped or moved by other conventional means to help push the oxygen bubbles out of the electrolyser. There is also mass transfer occurring due to the diffusion of the products formed on the cathode side to the anode side. Liquid products, such as ethanol thus either diffuse to the anode side or evaporate, as there is only on the order of a micrometers thin layer of water present on the cathode side. For negatively charged species, such as acetate and/or formate, additional electrostatic forces may further drive the diffusion, as the anode is positively charged. In a zero-gap cell, typically at least the anode is pressed against a separator so that the ohmic loss due to ion transfer is minimised. In another embodiment, there is a very small gap between the anode and the membrane (e.g. <5 mm), which only slight influences the ohmic losses but allows an easier removal of liquid products from the water stream, with minimal chance of getting oxidized on the anode. Liquid products reaching the anode may be removed by pumping the anolyte. If substantial liquid products are to be retrieved this way, the anolyte may be placed between the separator and anode to prevent anodic oxidation of products. If minimal liquid products are to be produced, the anode is typically pressed against the separator with the anolyte on the outside of the anode, and diffusion is allowed through the anolyte. This approach reduces ohmic losses and increases device energy efficiency.

The liquid electrolyte 4 may be any suitable salt, such as $K_2CO_3$, $KHCO_3$ or $CsHCO_3$ or e.g. higher charged soluble cations, such as $La^{3+}$. Alternatively, KOH or CsOH may also be used. Technically the salt with the smallest hydrated radius per charge is typically preferred. Preferably, the $CsHCO_3$ is between 1 mM and 0.1M $CsHCO_3$.

When deuterated or oxygen isotope labelled products are desired, some of the necessary constituents of the products are obtained from the salt or hydroxide provided as a liquid electrolyte. In these cases, the salt and/or hydroxide must be replaced with the appropriate isotopically labelled species (i.e. $CsDCO_3$ or $CsHCO_3{}^{18}$) in order to obtain the desired deuterated and/or oxygen-isotope labelled product.

A separator 3, such as a membrane is placed between the electrodes and separates the two electrodes from each other allowing only ions to transfer from one side to the other. The separator may be a membrane. In an embodiment, the membrane may be an anion exchange membrane, a cation exchange membrane, a bipolar membrane or a diaphragm, preferably an anion exchange membrane. The thickness of such a separator is in the order of a 20-200 micrometers, and the area is made to be slightly larger than the anode and cathode to prevent short circuiting at the edges.

In a zero-gap cell design, the anode 1 and cathode 2 are pressed against the separator 3, thus there is no gap between the cathode 2, anode 1 and the electrolyte 4. In an alternative embodiment, no membrane or separator is placed between the cathode 2 and anode 1, but rather a small (less than 5 mm) aqueous gap is provided. The membrane may be any conventional, commercially available membranes known in the art. The membranes are preferably pre-soaked in the isotopically labelled electrolyte (e.g. $D_2O$ or $H_2{}^{1B}O$/$HC^{18}O_3$) to ensure that a selectivity bias is created towards istopically labelled species.

Thus, in a typical setup, on the anode side, the anode 1 is fixed onto the separator 3 from one side and on the cathode side, the cathode 2 is fixed onto the separator 3 from another side, with the anode 1 and cathode 2 pressed against the separator 3 from both opposing sides as shown on FIG. 1.

On the cathode side, the cathode 2 may be directly pressed against the separator. A catholyte layer may be placed in between the separator and the cathode. When a catholyte layer is used it creates a space between the membrane and cathode, through which a liquid electrolyte may be flown. The catholyte layer may have a thickness of up to about 3.5 mm or less, such as 3 mm or less, e.g. 2.5 mm or less; e.g. 2 mm or less; e.g. 1.5 mm or less; e.g. 1 mm or less; e.g. 0.5 mm or less. A catholyte layer may allow for the easier extraction of liquid products. When a catholyte layer is used, the membrane is conveniently pre-soaked in deuterated membrane.

A cathode 2 may be placed, pressed or suspended in between the catholyte and the gas side. The cathode 2 typically comprises a porous catalyst support, on which the catalyst is deposited. The catalyst support may be a carbon paper or carbon cloth providing for a gas diffusion layer, onto which the catalysts are deposited. Hydrophobic materials, such as PTFE (Polytetrafluoroethylene) or PVDF (polyvinylidene fluoride) may also be used.

The catalyst is suitably a metal catalyst, preferably comprising at least one metal selected from Au, Zn, Ag, Cu, Sn, Zn, Bi, NiGa or Pb, preferably Cu, Ag or Bi. A catalyst is used to increase the rate of reaction and the choice of catalyst influences the products obtained. Moreover, the choice of catalyst also determines the end products and certain catalysts show higher selectivity towards one product than another. Therefore, depending on the end products to be obtained, the choice of catalyst may differ.

FIG. 2 summarises the Faradaic Efficiency (FE) for various metal electrodes, categorising the metal catalysts into four groups depending on the FE. The first group of metals consists of Pb, Hg, Tl, In, Sn and Cd with $HCOO^-$ as the primary product. The second group is Au, Ag, Zn, Pd and Ga with CO as the primary product. The third group consists of the Cu electrode and/or NiGa, producing $CH_4$ and other hydrocarbons. The fourth group consists of Ni, Fe, Pt and Ti with $H_2$ as the primary product as a result of a Hydrogen Evolution Reaction (HER).

The choice of catalyst determines the nature of the end product: a good catalyst for CO production may be a poor catalyst for HER, thus even though the standard potential for HER is lower than that of CO, the presence of a good CO catalyst will always favour CO production over HER.

The cathode 2 may also be a combined gas diffusion electrode-catalyst, for example electrodes made of pure Co, Ag, Ti or other suitable materials. Whether a separate catalyst is deposited on the gas diffusion electrode is determined by the gas diffusion layer material. For example, if the gas diffusion layer is silver, there is no further need to deposit a silver catalyst, if CO is desired as the product. However, there may be cases where even when a gas diffusion electrode is active for $CO_2$ electrolysis, and additional catalyst may be added to it (e.g. adding copper onto a silver mesh gas diffusion layer).

The catalyst may be deposited onto the gas diffusion layer by techniques known in the art, such as by spraying, dropcasting, sputtering, electrodepositing etc. Additives may also be added to the catalysts (e.g. Nafion, anion exchange ionomers, etc.) to control the local hydrophobicity/hydrophilicity levels and the ionic conductivity.

On top of the catalyst, a previously explained flow field is added on the cathode side to allow $CO_2$, CO or other gases to go through. Similar to the anode side and as explained above, a current collector and an endplate is provided on the cathode side.

In an assembled zero-gap cell, the cathode side also comprises an inlet line 5, inserted through the endplate into the flow fields comprising a carbon-containing species, such as $CO_2$ and/or CO. The carbon-containing species may be e.g. $CO_2$ or CO, preferably $^{11}CO_2$ and/or $^{12}CO_2$ and/or $^{13}CO_2$ and/or $^{14}CO_2$ and/or $^{11}CO$ and/or $^{12}CO$ and/or $^{13}CO$ and/or $^{14}CO$.

Other vapour phase species may also be present, such as $D_2O$, Ar, N, $O_2$, nitrogen- and/or sulfur-containing species etc. At least one of the O atoms in the carbon-containing species and/or the $D_2O$ may be selected from $^{16}O$, $^{17}O$ and/or $^{18}O$.

Typical gas flow rates can range from 10-40 mL/min/cm$^2$ active area. The gas flow rate depends on the mass transport properties of a given gas diffusion electrode, the operating current density, and the desired conversion of $CO_2$. However, other suitable gas flow rates may used depending on e.g. the size of the device. For example, gas flow rates of 5 mL/min to 150 mL/min are suitable for 4 cm$^2$ devices. The gas flow may be either a dry gas flow or a wet gas flow, where the relative humidity may be up to 100% by pretreating the gas by bubbling it in e.g. Isotopically labelled water. The gas flow rate at the inlet of the zero-gap electrolyser device is 10-500, such as 10-200, preferably 10-100 mL/min/cm$^2$ active area.

An outlet line 6 is inserted through the endplate into the flow field, opposite from the inlet line. The outlet line 6 allows the escape of the products from the zero-gap device. The outlet line 6 may be connected to an analytical device, for example a product quantification device, such as a gas chromatograph or mass spectrometer, however other suitable analytical devices may be used. The cathode outlet line 6 however does not typically comprise an outlet for liquids. The cathode outlet line 6 may however comprise an outlet for liquids when a liquid flow field is used.

The outlet line 6 and consequently, the outlet flow may be connected to a condenser or water wash prior to the analytical device to capture evaporated liquid phase products, such as ethanol, acetaldehyde, propanaldehyde, propanol, allyl alcohol, crotonaldehyde, glycoxal or others. A drying device, such as a dessicator may also be used to allow for purer products going into the analytical device.

A volumetric measuring device may be connected to the analytical device to allow for accurate volumetric measurements of the products. A tank may be connected to the outlet line for collecting the product(s).

The outlet line 6 may have a recycling loop connected to it, to recycle the partially converted products, such as CO, back into the electrolyser device. This reduces the costs and waste of starting materials.

In order to run the electrolysis, a power sources may be attached to the anode 1 and cathode 2, respectively. The device may be operated at either a constant current density or a constant voltage. Typically, a direct current (DC) drives the reaction. If a constant current density is used, the range may be from 100 mA/cm$^2$ up to 5000 mA/cm$^2$, preferably between 200-4000 mA/cm$^2$, more preferably between 1000-2000 mA/cm$^2$. If a constant voltage is used, this may range from 2V to 12V, preferably 2.5V-4V. In case a catholyte layer is used, the voltage range is suitably in 4-8V.

The temperature of the device during operation may range from about just above 0° C. to about 90° C. The temperature may be dependent on the type of separator used, as some commercially available separators may be able to withstand higher temperatures. Preferably, a temperature range of about 60° C. to about 80° C. is used. This elevated temperature also allows for the volatile organic compounds produced in the process to be obtained in the gaseous state.

The pressure may be at atmospheric pressure, however suitable pressure may be up to about 40 bar. The skilled person may select operating parameters such as pressure, temperature or humidity as required.

The electrolysis pH is typically maintained between 8-15 during operation. Preferably, the pH is maintained around 11.5-12.5. pH can be regulated as a function of current density, as the half-reaction produces hydroxyl groups. If isotopically labelled acetate is desired as a product, the preferred pH is between 13.5-15. The reasonining for the higher pH necessary for acetate is based on that acetate is formed via hydrolysis of a ketene intermediate and this reaction is catalysed by hydroxyl groups and thus the need for a higher pH.

$CO_2$ typically reacts with any base (e.g. NaOH, KOH, etc.) to form $KHCO_3$ at moderate pH (4-8) or $K_2CO_3$ at high pH (8-15). Thus, the alkaline consumes $CO_2$ and buffers it. In simpler 'beaker cell experiments', all $CO_2$ experiments are done at moderate pH, because even if a higher pH is to be obtained/maintained, the $CO_2$ will buffer it back down to a lower pH. However, in high current density gas diffusion electrode reactors, such as zero-gap cells, the $CO_2$ flows across the liquid layer. This was thought to get rid of the buffering effect, as the catalysis is more favourable in alkaline conditions, thus most prior art operates in highly alkaline mediums.

The inventors of the present invention analysed the outlet flow rate of the electrolysers and found that the cathode flow rate was small. The reason was that the unreacted $CO_2$ provided to the cathode would normally be expected to come out at the cathode. However, what actually happened was that the $CO_2$ provided to the cathode was neutralized by the alkali to a carbonate. The carbonate passed through the membrane, and the anode was acidic, which meant that the carbonate got re-converted back to $CO_2$ and thus $CO_2$ exited the electrolyser at the anode.

The implications of this are two-fold:

1) The products are typically measured by measuring the concentration and then dividing this by the flow rate, assuming that it was the same as the outlet flow rate. Depending on the flow rate, the outlet flow is actually surprisingly between 10-50% lower, i.e. the products obtained were overestimated by 10-100%.
2) Since KOH is used and this was converted to carbonate, KOH had to be continuously added to the reaction in order to run the experiments, otherwise the pH would neutralise over time. Thus, KOH did not just balance the pH, it effectively became part of the chemical reaction.

These issues are particularly relevant for $CO_2$ electrolysis. Since CO electrolysis does not form carbonates, the above-mentioned issues do not occur. Thus, as $CO_2$ electrolysis always buffers to a neutral pH, CO electrolysis naturally forces the cathode to higher pH.

In the present invention, varying the ratio of $CO_2$ to CO at the inlet gas is one method to control the pH. The more CO in the inlet flow the higher the pH, the more $CO_2$ in the inlet flow the lower the pH, Thus, the present invention presents a detailed way to control pH to more neutral pH.

The pH can be affected by the type of membrane used (anion exchange membrane, cation exchange membrane or diaphragm).

Anion Exchange Membranes+$CO_2$–pH Control

The pH of the $CO_2$ electrolyzer can be controlled from pH 8-14. The steady-state condition using a zero-gap approach with an anion exchange membrane will lead to a bulk pH near that of carbonate, which is approximately between pH 10-12 depending upon the salt concentration. Bringing in an acid (e.g. HCl) or an alkali (e.g. KOH) either diffusing through the anode or through microbubbles from the inlet cathode gas will temporarily allow for variations in pH's (from 4 up to pH 14), though these alkali pH's will have the alkali react with $CO_2$ to form carbonates, thus lowering the pH over time, whereas acidic pH's will react with carbonates or hydroxides, thus increasing the pH over time. Continual adding of acid or base is needed to prevent any pH other than that of carbonates.

Controlling pH in diaphragms is similar to that in anion exchange membranes.

Anion Exchange Membranes+CO–pH Control

Managing pH in CO electrolysis pH is different that $CO_2$ electrolysis, since CO electrolysis does not form a buffering carbonate pH. For operating a zero-gap reactor in conditions with an anion exchange membrane, the steady state condition of pure CO electrolysis will lead to an alkaline pH. The actual pH is a function of the cation concentration at the cathode and can be controlled to be anywhere between pH 10 and pH 14. For example, if the local cation concentration is 1M of potassium ions, this would entail 1M KOH, and a pH of 14. These cations can be produced through direct spraying onto the cathode or diffusion from an anolyte through anion exchange membranes (as all membranes are less than 100% permaselective) over to the cathode. In cases where a liquid anolyte is present, cations will diffuse through the membrane either from or to the cathode over time, which could be on the hours or even hundreds of hours time scale, thus providing a non-steady state variation in pH over time. This can be controlled via operating potential, cathodic water management or variations in membranes.

A more controlled way to manage the pH is through doping the CO flow with amounts of $CO_2$ gas. This $CO_2$ provides a temporary local buffering effect by forming an in-situ carbonate at the cathode. As this carbonate will transfer through the anion exchange membrane to the anode, the $CO_2$ needs to be continually added in the inlet line. The exact $CO/CO_2$ ratio needed for a given pH depends on flow rate, current density, conversion, and mass transfer in relation to the inlet flow fields and gas diffusion layer. The span of pH's the reactor can achieve using this approach is from pH 10 to pH 14.

Acetate is produced as a product from $CO_2$ and CO electrolysis, and formate a product in $CO_2$ electrolysis. If these species are not extracted from the system (or oxidized anodically), they can also be used to control the pH. This is most useful with acetate as it is durable against anodic oxidation. Thus adding acetate in the anolyte to have it diffuse to the cathode is another way to control the pH. This allows a method to lower the pH from the equilibrium pH (typically 10-12 for $CO_2$ electrolysis and 13-14 for CO electrolysis) all the way down to pH 5, which is slightly above the pKa of acetate/acetic acid.

Cation Exchange Membranes

For cation exchange membranes using a zero-gap reactor design the membrane interface will have a pH of approximately 0 as protons will be emitting from their surface. The actual pH near the catalyst for CO electrolysis will be a function of how fast the electrolysis can co-produce hydroxyl anions (one hydroxyl group is produced per electron transferred) and the distance and diffusion rate of the hydroxyl groups. Thus, the pH at the catalyst can be controlled to be anywhere from pH 0 at low current densities (<100 mA/cm$^2$) to pH=14 for high current densities (>500 mA/cm$^2$) and sufficient distance from the membrane (>100 nm). $CO_2$ electrolysis will proceed similarly, though the hydroxyls may convert to carbonates, and thus the reasonable pH range that one is able to achieve will be from pH 0 to pH 12.

Bipolar Membranes

Controlling pH in bipolar membranes is similar to that in anion exchange membranes for bipolar membranes operating in forward bias and similar to cation exchange membranes for bipolar membranes operating in reverse bias.

In an embodiment, the pH is typically maintained by continuously adding an acid, such as HCl or an alkali, such as KOH. The acid or the alkali may be diffused through the anode to maintain the pH or the acid or the alkali may be added through microbubbles from the inlet cathode gas.

Alternatively or additionally, the pH may be maintained by adjusting the $CO_2$ to CO ratio to between about 0:1 and about 5:1 at the inlet. To buffer the pH using $CO_2$, this could entail a $CO_2$:CO ratio as high as 5:1 to maintain the lowest pH and no or very low $CO_2$, such as to about 0:1 $CO_2$:CO, to about 1:1 $CO_2$:CO, to about 2:1 $CO_2$:CO, to about 3:1 $CO_2$:CO and to about 4:1 $CO_2$:CO to maintain the highest pH.

Figure 3A:
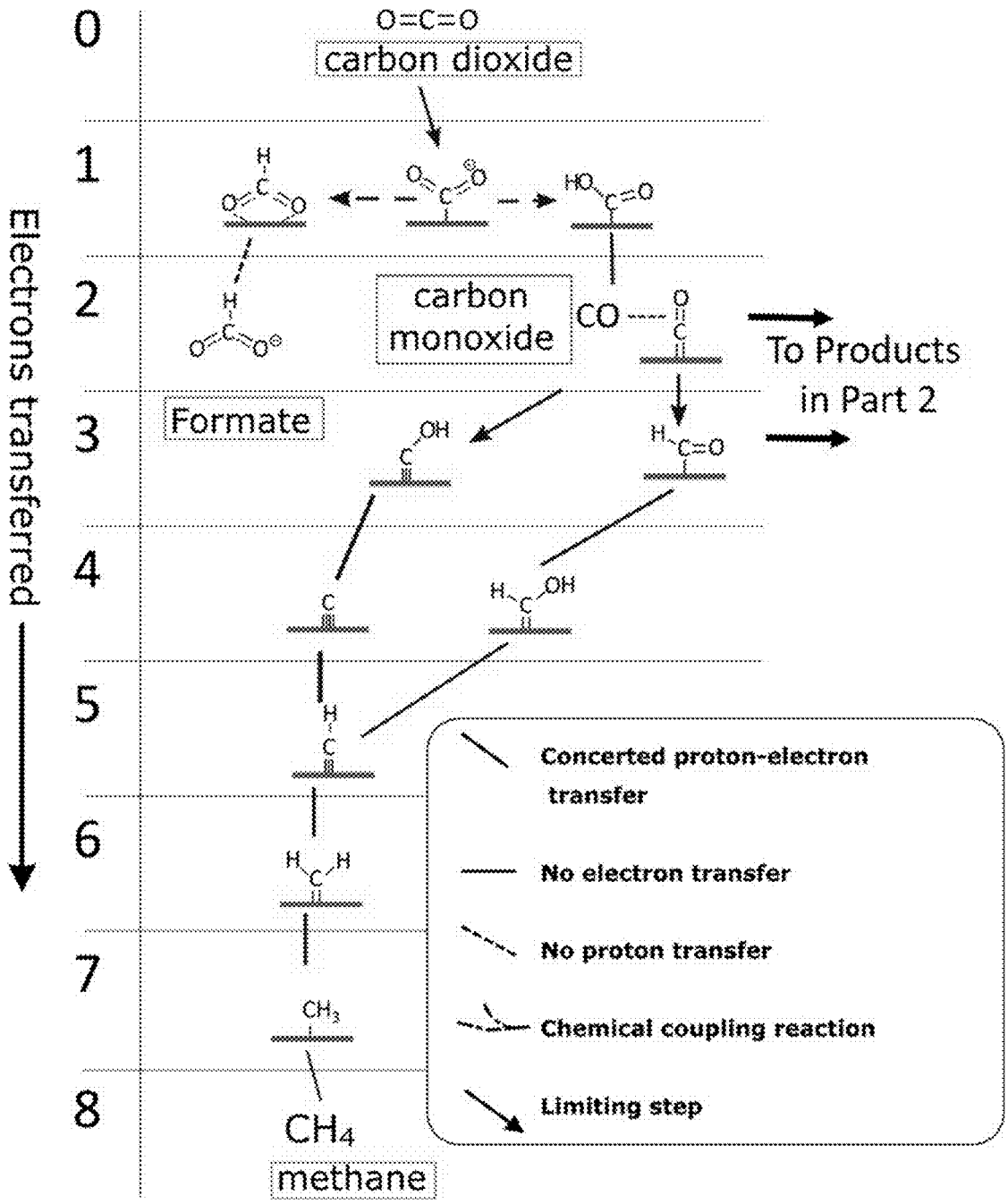
Figure 3B:
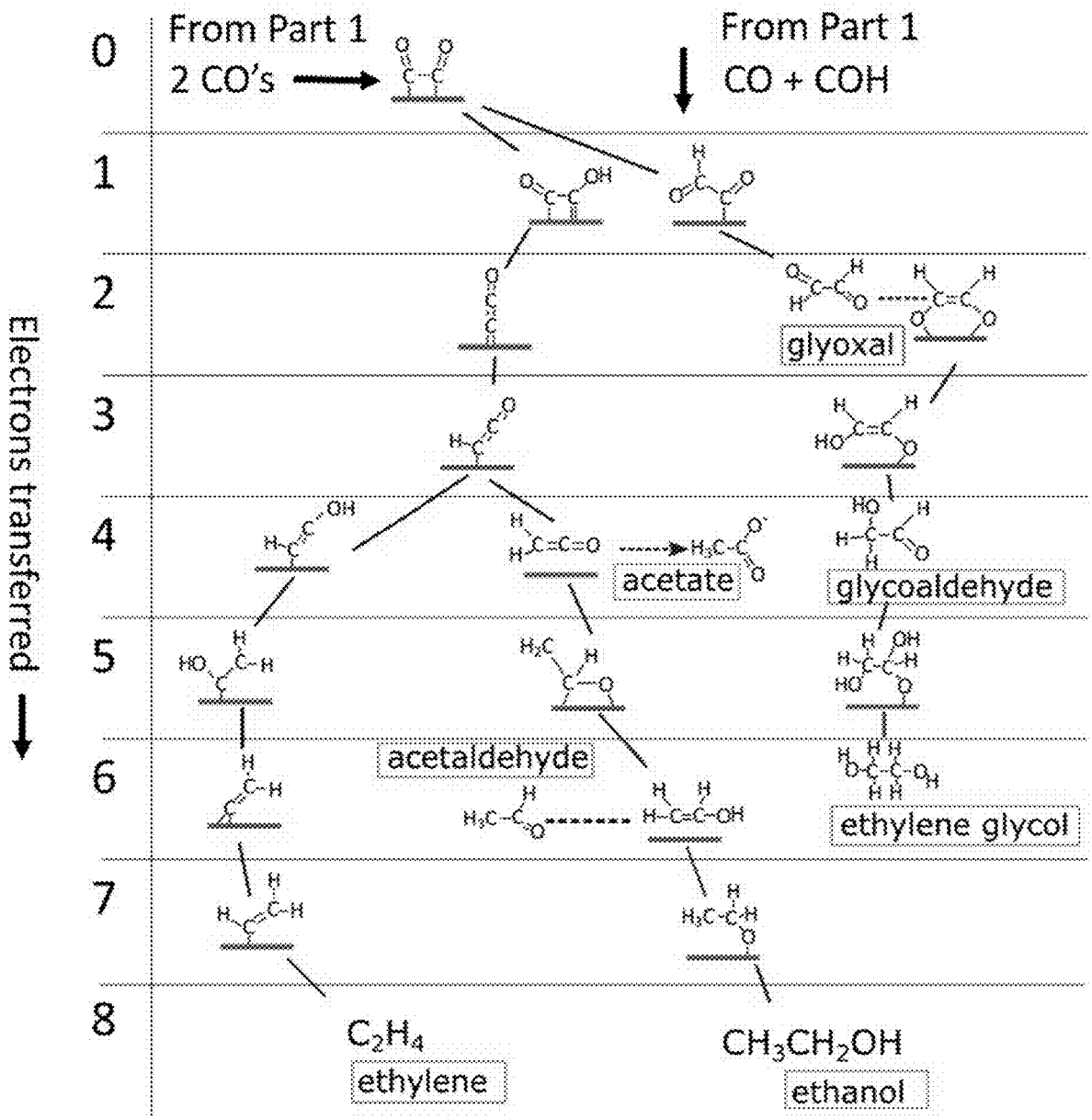

FIGS. 3*a* and 3*b* show the current hypothesis in literature on the typical path of conversion of $CO_2$ and/or CO to the end products. Carbon dioxide is reduced either into formate or carbon monoxide (CO). The choice of catalyst decides which route is favoured. As explained above, catalysts such as Pb, Hg, Tl, In, Sn, Bi and Cd primarily lead to obtaining formate ($HCOO^-$) as the primary product. When a catalyst selected from Au, Ag, Zn, Pd and Ga, CO evolves as the primary product. Preferably, the catalyst used for CO formation is Ag and the catalyst used for formate production is Bi.

The formate route ends in the production of formate ($HCOO^-$) which may be separated and converted into formic acid and/or other products. The formate may also be left in the product mixture for a later separation step. The formate may also penetrate through the membrane to arrive at the anode side; alternatively, if there is a liquid gap between the cathode and the separator and the formate produced may form part of the catholyte flow.

CO may take several paths leading to varying product distribution, as illustrated in FIG. 4, depending on e.g. the type of catalyst used, electrolyte concentration and ionic composition, partial pressure, temperature, local pH at the catalyst and local concentration of species (i.e. mass transfer related effects) etc. A suitable catalyst may be Cu, producing $CH_4$ and other hydrocarbons as illustrated in FIGS. 3*a* and 3*b* and 4.

The end products of CO typically comprise ethylene ($C_2H_4$), methane ($CH_4$), formate ($HCOO^-$), acetate ($C_2H_3O^-$), ethanol ($CH_3CH_2OH$), acetaldehyde ($CH_3CHO$), ethylene glycol ($(CH_2OH)_2$), propanaldehyde ($C_3H_6O$), propanol ($C_3H_8O$), allyl alcohol ($C_3H_6O$) and glycoaldehyde ($C_2H_4O_2$).

The inventors of the present invention surprisingly discovered that the $CO_2$ electrolysis reaction may be run using isotopes of the starting materials, thus directly leading to a range of isotopically labelled organic compounds. Further, the inventors also discovered that pure and mixed isotopically labelled organic compounds may also be produced by the present process. The selectivity of isotopically labelled products over non-Isotopically labelled products is suitably greater than at least 60%, such as at least 70%, at least 80%, at least 90%, at least 95% or at least 99%.

The inventors of the present invention also surprisingly found that the selectivity towards isotopically labelled products over non-isotopically labelled products is greater than at least 90%.

The isotopically labelled compound described herein or a mixture of isotopically labelled organic compounds or organic salts described herein find use a as contrast agents. The isotopically labelled compounds may also find use as organic solvents or fine chemicals used in analytical devices. A large use is as solvents for Nuclear Magnetic Resonance (NMR) analysis.

EXAMPLES

This work was partially supported by funding from the European Union's Horizon 2020 research and innovation programme under grant agreement no. 851441 (SELECTCO2).

Example 1

A cathode (sputtered Cu with thickness of 150 nm on carbon paper) and an anode ($IrO_2$-coated carbon paper electrode (Dioxide Materials™)) were provided, with the cathode and anode separated by an anion exchange membrane (AEM) (Sustainion® membrane X37-50 RT (Dioxide Materials™)) such that a zero-gap cell was obtained in accordance with the invention. The fresh AEM was inserted between the cathode and anode, providing a cathode area of 2.25 $cm^2$ and anode area of 4 $cm^2$ for conducting the experiments. PTFE gaskets were further provided to sandwich the cathode-membrane-anode assembly such that a close interaction is provided over substantially the entire surface areas of the cathode, membrane and electrode.

Conductive flow fields enclosed the gaskets and endplates were provided to sandwich the flow fields. The flow fields were fastened with cell bolts with an estimated torque of 3 Nm to provide sufficient compression and avoid gas or liquid leakages from the system.

The $CO_2$ gas (AGA, purity 4.5N) was fed into the cathode using a mass flow controller (Red-y, Voegtlin) at 40 mL/min and further humidified by sparging into a container filled with deionized water.

The anode side was fed with 0.1 M aqueous $KHCO_3$ and recirculated continuously using a diaphragm pump (KNF). A potentiostat (Bio-Logic VSP 300 with booster unit) operating in galvanostatic mode with a range of 50-300 mA/$cm^2$ was provided as the power source. A heating oven provided to control temperature. The cathode outlet stream was measured continuously using a volumetric flow meter (MesaLabs, Defender 530+). Quantification of the gas products was determined with a gas chromatograph (PerkinElmer® Clarus® 590 GC) equipped with the Molecular Sieve 13× and HayeSep® Q packed column using Ar (10 mL/min) as the carrier gas and with a thermal conductivity detector (TCD).

A water trap was provided after the $CO_2$ outlet line to collect liquid products at the cathode and the anode. The collected liquid products were quantified using a high-performance liquid chromatography (HPLC) instrument, the instrument comprising an Agilent 1260 Infinity unit with refractive index detectors (RID) and diode array detectors (DAD), equipped with a Bio-Rad Aminex® HPX-87H column. The column was heated isothermally, and an aqueous solution of $H_2SO_4$ (5 mM with a flow of 0.3 mL/min) served as the eluent, measuring each sample for 60 minutes. Data analysis of the liquid products obtained at both the cathode and the anode side (taking into consideration the crossover of the different compounds) are presented in FIG. 4.

Example 2

$CO_2$ electrolysis using $D_2O$ as hydrogen source to produce isotopically labelled products The overall reaction may be characterised by the overall reaction of:

$$xCO_2 + yD_2O \rightarrow d\text{-product} + zO_2$$

The cathode is a 1×1 $cm^2$ Sigracet 39BB with 150 nm sputtered Cu. The anode catalyst is a 1.5×1.5 $cm^2$ $IrO_2$ from Dioxide Materials™. The membrane was a 25 μm thick anion-exchange membrane. Prior to assembly the membrane had been activated in 1M $KHCO_3$ and then soaked in $D_2O$ to avoid H contamination. 0.01" thick PTFE gaskets were cut to surround the electrodes and to contain fluids within the cell. In the assembled membrane electrode assembly the catalysts are facing the membrane. The cell is assembled with bolts and nuts using a torque of 3 Nm. After assembly the potentiostat is connected in a two-electrode configuration with the working electrode connected to the cathode and the counter electrode connected to the anode. The $CO_2$ gas is fed to the cathode inlet, a mass spectrometer and gas chromatograph are connected to the cathode outlet, and the electrolyte is fed to the anode.

Figure 5:
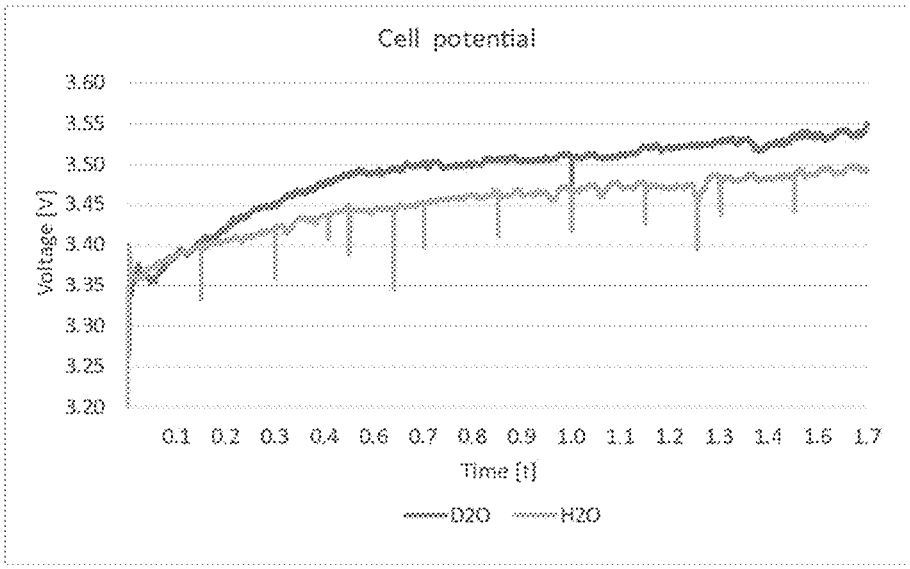
FIG. 5 shows the cell potential of the $CO_2$ electrolyser using $D_2O$ and $H_2O$ as anolyte as function of time at 200 mA/cm$^2$.
Figure 6:
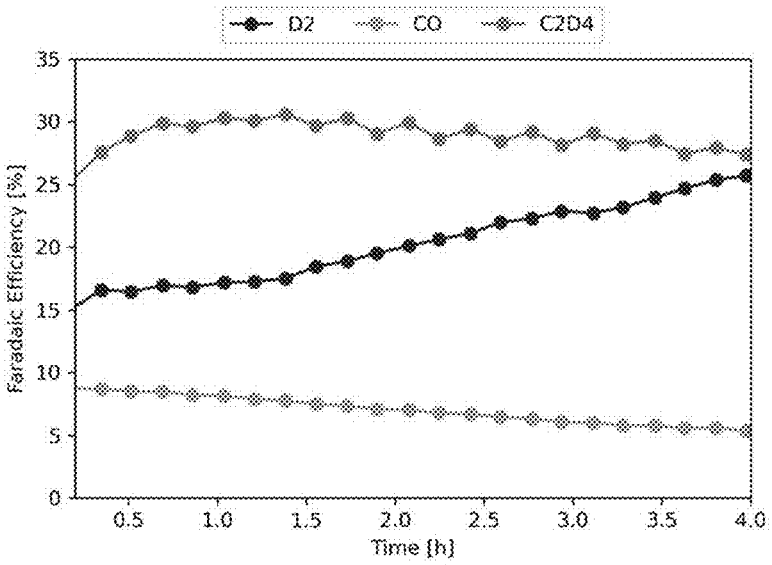
FIG. 6 shows the Faradaic Efficiency for the gaseous products measured with a gas chromatograph during operation at 200 mA/cm$^2$.

FIG. 5 shows the cell potential of the $CO_2$ electrolyser using $D_2O$ (Deuterium Oxide 99.90D %) and $H_2O$ as anolyte as function of time at 200 mA/cm$^2$. FIG. 5 shows a higher cell potential using $D_2O$+0.1 M $Cs_2CO_3$ anolyte with D as the primary hydrogen source in contrast to H. This increase in cell potential is due to a higher dissociation energy of $D_2O$ than that of $H_2O$. The Faradaic Efficiency for the gaseous products measures with a gas chromatograph during operation at 200 mA/cm$^2$ is shown on FIG. 6. Ethylene is the primary product with CO and $H_2$ also notable products. Ethanol, acetaldehyde, propanol and other liquid products are also produced, but are typically measured ex-situ. A mass spectrometer was used to find the degree of deuteration of gaseous products.

Figure 7:
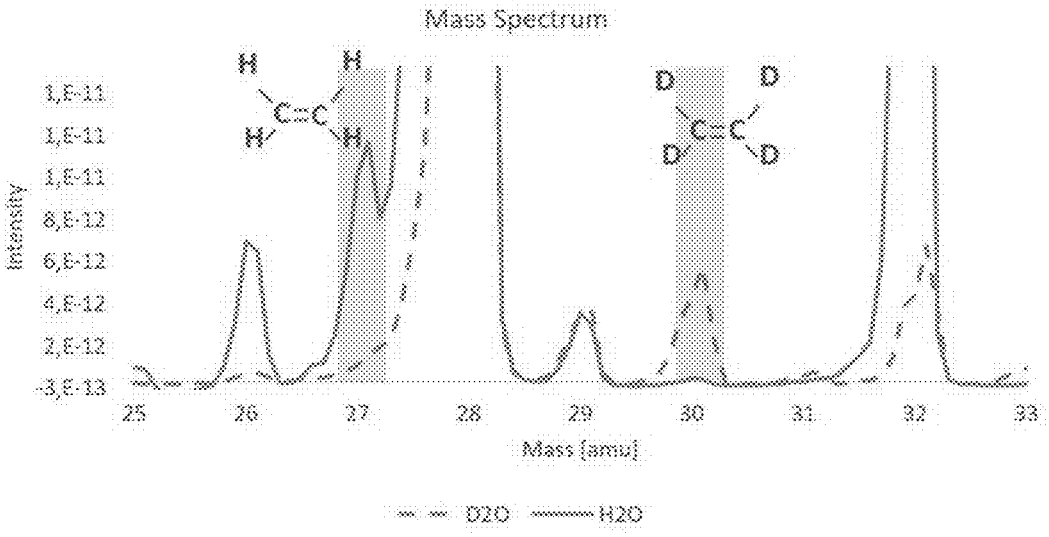
FIG. 7 shows the mass spectrum of the outlet gas from the electrolyzers from mass to charge ratio 25 to 33 with $D_2O$ and $H_2O$ as hydrogen sources.

FIG. 7 shows the mass spectrum of the outlet gas from the electrolyzers from mass to charge ratio 25 to 33 with $D_2O$ and $H_2O$ as hydrogen sources. Due to the cracking patterns, $C_2H_4$ is expected to show a peak at 27. This clearly shows that the reactor operating with $H_2O$ produces $C_2H_4$ whereas the reactor with $D_2O$ produces negligible amounts of $C_2H_4$. Due to the high mass signal at mass 28 from CO this slightly overlaps on mass 27, thus adding a slight amount of uncertainty into quantifying the data. Due to the cracking patterns, $C_2D_4$ is expected to have a mass fragment at mass 30. From FIG. 7 a peak at mass 30 with $CO_2$ electrolysis with $D_2O$ can clearly be seen, but only negligible amounts are observed with $H_2O$. Thus, from analysing the mass 27 and mass 30 peak, the inventors have achieved at least 90% conversion to deuterated products (over hydrogenated) using the disclosed $D_2O$ approach, but this could be significantly higher with more precise mass spectrometry analysis.

Figure 8:
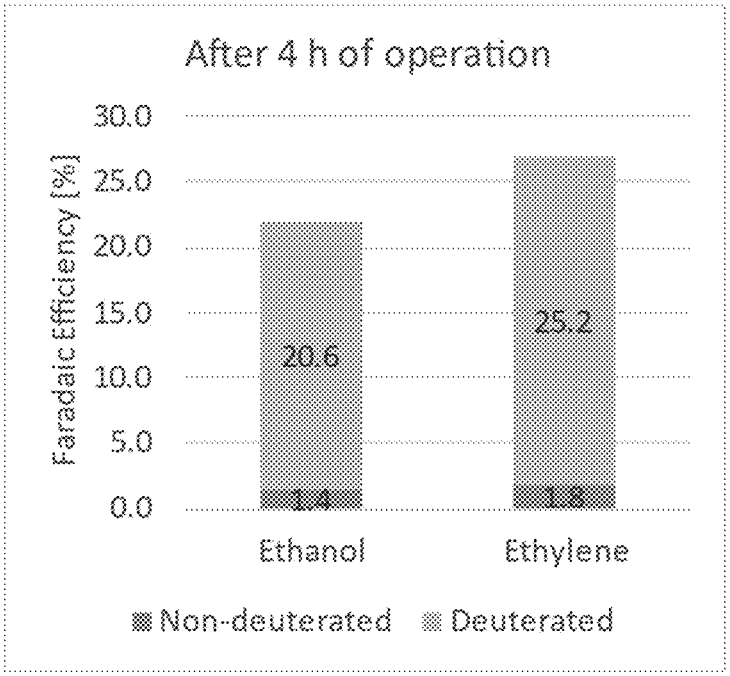
FIG. 8 shows the Faradaic Efficiency and degree of deuteration for ethanol and ethylene after 4 hours of continuous operation, quantified using an HPLC chromatography.

FIG. 8 shows the Faradaic Efficiency and degree of deuteration for ethanol and ethylene, respectively. The Faradaic Efficiency and degree of deuteration for ethanol quantified using a high-performance liquid chromatography and the $C_2D_4$:$C_2H_4$ ratio to determine degree of deuteration. The Faradaic efficiency and degree of deuteration for ethylene quantified using a gas chromatography and the $C_2D_4$:$C_2H_4$ ratio to determine degree of deuteration.

The invention claimed is:

1. A process for producing an isotopically labelled organic compound or a mixture of such compounds in a gas-fed zero-gap electrolyser device comprising a separator, the process involving electrolysis of a gas comprising:

a carbon-containing species, in said gas-fed zero-gap electrolyser device, in the presence of a catalyst, $D_2O$, and a cation;

wherein at least one of the C atoms in the carbon-containing species is selected from $^{11}C$, $^{12}C$, $^{13}C$ and/or $^{14}C$; and/or wherein at least one of the O atoms in the carbon-containing species and/or the $D_2O$ is selected from $^{16}O$, $^{17}O$ and/or $^{18}O$; and wherein the process comprises pre-soaking the separator in $D_2O$ prior to the electrolysis of the gas.

2. The process according to claim 1, wherein the catalyst is a metal catalyst, preferably comprising at least one metal selected from Au, Zn, Ag, Cu, Sn, Zn, Bi, Ni, Ga or Pb.

3. The process according to claim 1, wherein the carbon-containing species is $CO_2$ or CO.

4. The process according to claim 1, wherein the separator is a membrane or a diaphragm.

5. The process according to claim 4, wherein the membrane is an anion exchange membrane, a cation exchange membrane, a bipolar membrane.

6. The process according to claim 1, wherein a gas flow rate at an inlet of the zero-gap electrolyser device is 10-500 mL/min/cm$^2$ active area.

7. The process according to claim 1, wherein the zero-gap electrolyser does not comprise a cathode outlet for liquids.

8. The process according to claim 1, wherein the electrolysis pH is maintained between 8-15 during operation.

9. The process according to claim 8, wherein the pH is maintained by continuously adding an acid or an alkali.

10. The process according to claim 9, wherein the acid or the alkali is diffused through the anode.

11. The process according to claim 9, wherein the acid or the alkali is added through microbubbles from an inlet cathode gas.

12. The process according to claim 8, wherein the pH is maintained by adjusting a $CO_2$ to CO ratio to between about 0:1 and about 5:1 at an inlet.

13. The process according to claim 1, wherein a constant current density applied across the zero-gap electrolyser device is between 100 mA/cm$^2$ to 5000 mA/cm$^2$.

14. The process according to claim 1, wherein a constant voltage applied across the zero-gap electrolyser device is between 2V to 12V.

15. The process according to claim 1, wherein a selectivity of isotopically labelled products over non-isotopically labelled products is greater than at least 90%.

16. The process according to claim 1, wherein the carbon-containing species is $^{11}CO_2$, $^{12}CO_2$, $^{13}CO_2$ and/or $^{14}CO_2$ and/or $^{11}CO$, $^{12}CO_2$, $^{13}CO$ and/or $^{14}CO$.

17. The process according to claim 1, wherein a gas flow rate at an inlet of the zero-gap electrolyser device is 10-200 mL/min/cm$^2$ active area.

18. The process according to claim 1, wherein a gas flow rate at an inlet of the zero-gap electrolyser device is 10-100 mL/min/cm$^2$ active area.

19. The process according to claim 1, wherein the electrolysis pH is maintained between 11.5-12.5 during operation.

20. The process according to claim 1, wherein the pH is kept between 13.5-15 so as to produce isotopically labelled acetate.

21. The process according to claim 1, wherein the constant current density applied across the zero-gap electrolyser device is between 200-4000 mA/cm$^2$.

22. The process according to claim 1, wherein the constant current density applied across the zero-gap electrolyser device is between 1000-2000 mA/cm$^2$.

23. The process according to claim 1, wherein the catalyst is a metal catalyst selected from Cu, Ag or Bi.

* * * * *